United States Patent [19]

Peters

[11] Patent Number: 4,841,695

[45] Date of Patent: Jun. 27, 1989

[54] DEVICE FOR REDUCING MOISTURE BENEATH A ROOFING STRUCTURE

[76] Inventor: William H. Peters, 502 E. North Parkway, West Unity, Ohio 43570

[21] Appl. No.: 187,915

[22] Filed: Apr. 29, 1988

[51] Int. Cl.[4] ..... E04D 13/16

[52] U.S. Cl. ..... 52/199

[58] Field of Search ..... 52/199; 98/42.01, 122

[56] References Cited

U.S. PATENT DOCUMENTS

| | | | |
|---|---|---|---|
| 4,386,488 | 6/1983 | Gibbs | 52/199 |
| 4,484,424 | 11/1984 | Logsdon | 52/199 |
| 4,593,504 | 6/1986 | Bonnici | 52/189 |
| 4,622,887 | 11/1986 | Peterson | 98/42.01 |

FOREIGN PATENT DOCUMENTS

| | | | |
|---|---|---|---|
| 150145 | 9/1920 | United Kingdom | 98/122 |
| 121737 | 11/1970 | United Kingdom | 52/199 |

OTHER PUBLICATIONS

United Kingdom printed application 2 100 315 A, 12-1981 (1st drawing 3 pages spec.).

*Primary Examiner*—John E. Murtagh

*Attorney, Agent, or Firm*—George R. Royer

[57] ABSTRACT

The subject invention is a device used to help dehydrate and dehumidify the substructure immediately under the roof structure. The subject device includes an air intake member adapted to eject relatively humid air, under the roof surface, said device being in the form of a longitudinally extending, vertically upwardly protruding finger-like member formed as a one-piece member having an internally disposed longitudinally extending internal chamber which communicates with an opening in the bottom thereof, which opening in turn communicates with yet another opening in the roof structure which second opening communicates to spatial areas immediately beneath the roof structure. The upper part of the device has a plurality of openings that communicate from the internal chamber to spatial areas outside said unit. A thimble-like cover is emplaced in conforming fashion over the upper part of the finger-like member, which thimble is positioned in such a manner so as to be pivotably mounted at its uppermost part for limited pivotable movement at its bottom portion so as to provide a spatial zone at the bottom for air venting purposes at such bottom.

3 Claims, 2 Drawing Sheets

DEVICE FOR REDUCING MOISTURE BENEATH A ROOFING STRUCTURE

DISCUSSION OF PRIOR ART AND BACKGROUND OF INVENTION

The subject invention pertains to roofing systems in general, and is addressed to a device to help remove moisture and alleviate moisture level under a roof from inside the building and immediately under the roof structure. The invention is adapted to take in relatively dry air from outside the building, and thence disperse same under the roof structure.

In this latter regard, most buildings generally have a layer of insulation placed either immediately below the roof level for heat preservation purposes. Such insulation layer, in flat roofs or otherwise, is frequently positioned immediately below the undersurface of the flat roof. In some installations there may be a relatively narrow air gap between the insulation layer and the roof deck provided for circulation purposes for purposes of alleviating the moisture problem in the insulation layers.

In the past, there have been an array of inventions conceived and produced to dehydrate the insulation material so as to prevent damage to the roof and building infrastructure. Several such inventions have been structured as simple ventilating systems to merely direct air currents over a portion of the insulation layer, usually the upper surface, however, none have utilized a simplistic device that effectively provides a general flow of relatively dry air both within and immediately outside the insulation material. It is this state of art and general problem area that gives rise to the conception of the subject invention, and the following designated objects of the subject invention are directed accordingly.

OBJECTS

An object of the subject invention is to provide an improved ventilating device for dehumidifying insulation materials disposed immediately beneath a roof structure;

An additional object of the subject invention is to provide an improved dehydrating device for aerating an insulation system under a building roof structure;

Still another object of the subject invention is to provide an improved dehumidifying device for a building;

Yet another object of the subject invention is to provide an improved apparatus for using wind currents to dry the insulation layer and other components under a building roof structure;

Other and further objects of the subject invention will become apparent from a reading of the following description taken in conjunction with the claims.

DRAWINGS

DESCRIPTION OF GENERAL EMBODIMENT AND SUMMARY OF INVENTION

The subject invention is a device used to help dehydrate and dehumidify the substructure immediately under the roof structure. The subject device includes an air intake member adapted to eject relatively humid air, under the roof surface, said device being in the form of a longitudinally extending, vertically upwardly protruding finger-like member formed as a one-piece member having an internally disposed longitudinally extending internal chamber which communicates with an opening in the bottom thereof, which opening in turn communicates with yet another opening in the roof structure which second opening communicates to spatial areas immediately beneath the roof structure. The upper part of the device has a plurality of openings that communicate from the internal chamber to spatial areas outside said unit. A thimble-like cover is emplaced in a loose and conforming fashion over the upper part of the finger-like member, which thimble is positioned in such a manner so as to be pivotably mounted at its uppermost part for limited pivotable movement at its bottom portion so as to provide a spatial zone at the bottom.

DESCRIPTION OF PREFERRED EMBODIMENT

In describing the preferred embodiment of the subject invention, it must be stressed that this preferred embodiment is only one embodiment of the subject invention, as other embodiments fall within the scope of the claims. Therefore, the following description shall not be construed to limit the scope of the claims herein.

Figure 1:
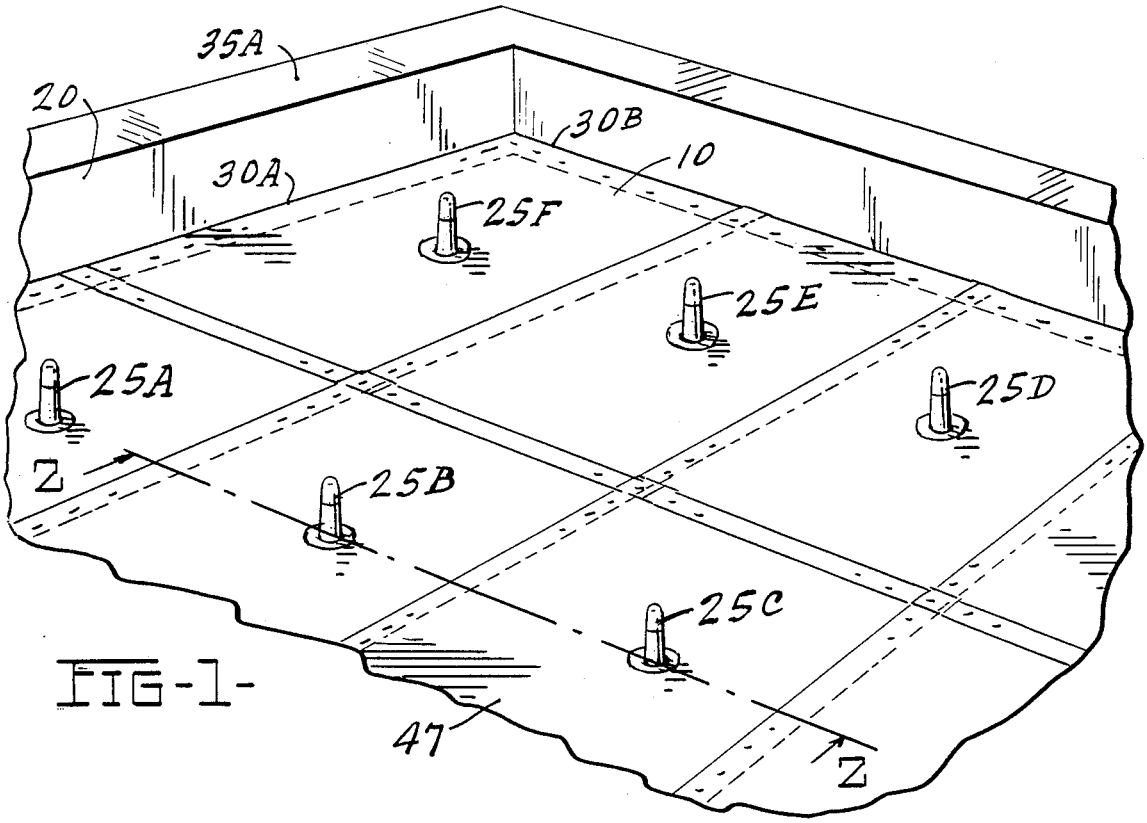
FIG. 1 is a perspective view of the subject ventilating system, as shown from above a building showing how the subject system looks on top of the roof of the building.
Figure 2:
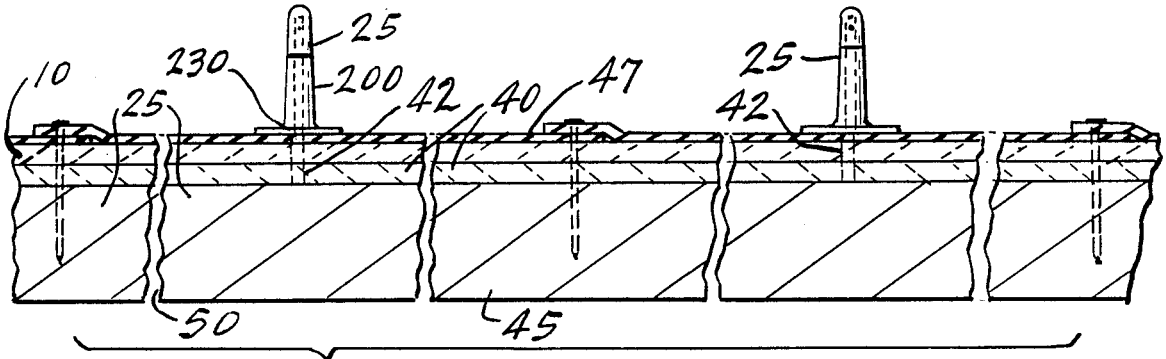
FIG. 2 is a side elevational view in section of the subject ventilating system showing the location of individual units of the subject invention.

Referring to the drawings and particularly FIGS. 1 and 2, an overall view of the installation of the subject intake device 5 is shown as it is emplaced in a roof structure 10 on a building structure 20. Further, the apparatus described below may be installed or retrofitted into an existing building structure. Specifically, as shown, the subject apparatus encompassing the subject invention is a dehumidifyer apparatus for aiding in the removal of moisture from the insulation layer 45 immediately under the upper roof structure 10, as such roof strcture is utilized as a protective layer over building 10 as can be seen from the drawings. The subject apparatus generally includes as its major elements the following members: First, there is at least one air intake element 25 disposed on the upper surface of the roof structure 10, as shown, or at some location outside a building 20 being adapted to draw relatively dry air from outside so as to help dehumidify the roof substrcture, and the insulation layer 45 thereunder. Disposed immediately beneath each air intake element 25 is an opening 42 in the roof 10 which opening is adapted to pass the air from the air intake element 25 to the areas beneath the roof substructure 10 to pass said air to the insulation layer 45, and areas juxtaposed theeby. As shown, a plurality of such air intake members 25A, 25B...25F may be used in some spatial relationship over the roof surface.

Attention is again addressed to FIGS. 1 and 2 in which the roof 10 and building structure 20 interrelationship is shown, and as seen the building 10 is graphically displayed and represented as a conventional rectangular structure with the horizontal roof 10 disposed on the upper portion thereof. As can be determined from a view of FIG. 1 the roof 10 covers the upper part of the building 20, with the roof extending laterally to the upper perimeter edges 30A, 30B... of the building 20. Such latter perimeter edges are generally defined by the upper edges of the building sides such as building side 35A shown in FIG. 1.

Figure 3:
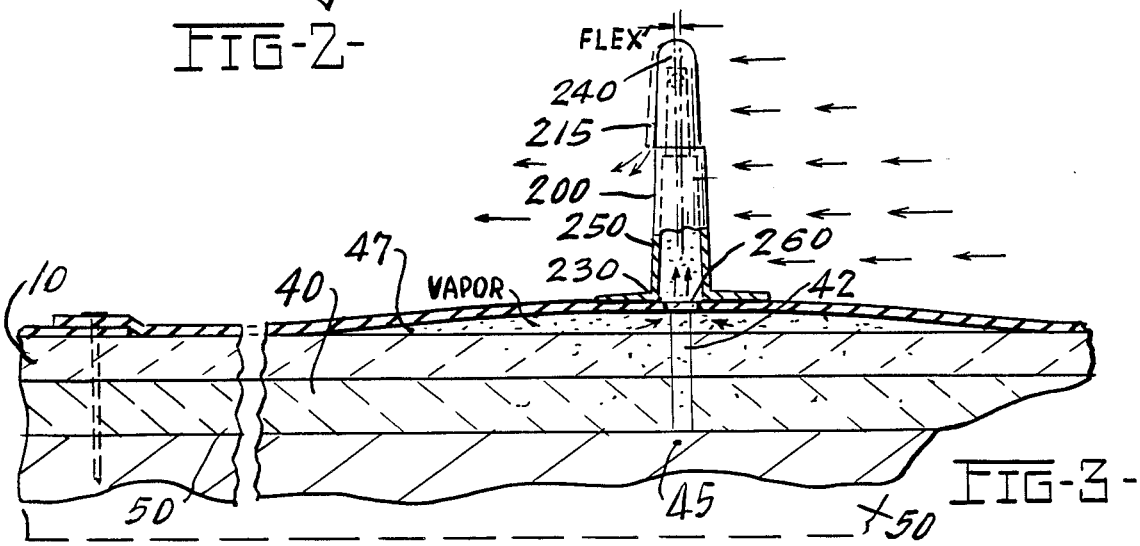
FIG. 3 is a side elevational view of the subject system showing how the air intake arrangement and distribution apparatus operates.

As can be seen in FIGS. 2 and 3 the general roof infrastructure generally comprises a lower rigid deck 40 which may be metal or wood, which lower deck provides the base structural support for the roof infrastructure. The horizontally disposed insulation layer 45 is usually emplaced horizontally either over or under the top of the roof deck 40 in a flush manner, as shown. In the embodiment shown in the drawings, the insulation layer 45 is set under the roof deck 40. This insulation layer 45 functions to prevent the escape of rising heated air in the building 20 and generally helps to retain air temperature levels inside the building at optimal levels. In most applications the external roof deck 40 is then emplaced in a generally horizontal and flush manner over the upper surface of the insulation layers 45, as can be determined from a view of FIGS. 2 and 3. In many more recent and modern applications, the upper protective covering of roof structure 10 is comprised of rubber sheath cover 47. At this point, it must be emphasized that the structural principles of the subject invention remain generally applicable even though the foregoing roof structure may vary, such as when the insulation layer 45 is disposed over the roof deck 40, or when other than rubber materials are used over roof 10, or whatever other structural arrangement may be utilized.

As stated, the roof 10 is generally shown to be a horizontal, flat roof covering adapted to cover a building 20 with a roof deck 40 functioning as the upper fixed part of the superstructure and frame of building 20. As can be seen from FIG. 3, the spatial area 50 beneath the roof infrastructure 10 is generally partially filled and comprised of a loose insulation layer which is adapted to insulate heat loss through roof infrastructure 10. Generally immediately beneath this insulation layer is a secondary support ceiling, not shown, which is adapted to secure and hold the insulation in the spatial area 50, as seen in the drawings. It is generally the spatial area 50 with its insulation layer that usually absorbs a substantial amount of moisture from the roof and other sources inside and outside the building. Because of this moisture problem, means are needed to dehumidify the insulation or spatial area in order to minimize building damage or other problems.

Figures 4, 5, 6, 7:
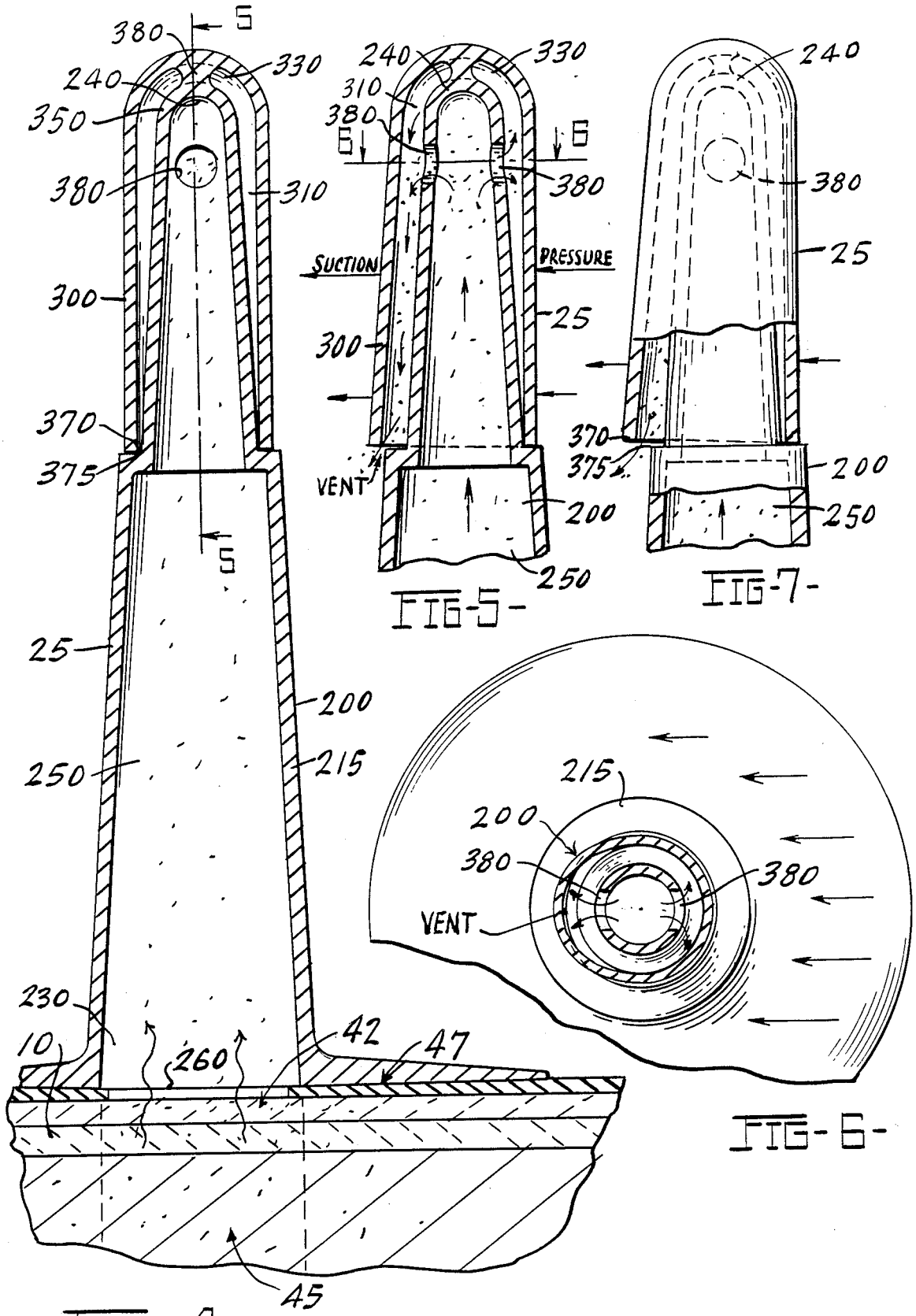
FIG. 4 is a side elevational view partially cut away to show the inside structure of the subject apparatus.
FIG. 5 is a side elevational view, in cross section, of the upper part of the subject device.
FIG. 6 is a top elevational view of the subject device shown in section, showing schematically the air intake flow pattern.
FIG. 7 is a side elevational view of an alternate embodiment of the subject device.

Attention is again directed to FIGS. 3 and 4 in which is shown the air intake member 5. As shown, the air intake system may comprise a series of such individual units disposed over the upper surface of said roof structure 10. Such an air intake member 5 in general comprises a longitudinally extending housing member 200 shaped like a finger. Such housing member has a first end 230 which is the bottom end and a second end 240 which is the top end. More particularly, such longitudinally extending member 200 appears parabolic in shape, in a cross-sectional view from a side elevation, as shown in FIG. 4 and in cross-sectional view from the top appears round, as in FIG. 6. The base housing member 200 has a hollow interior chamber 250 of longitudinal extent and which chamber conforms in general to the outer rounded surface configuration 215 of the longitudinal housing member 200.

As can be seen from the drawings, the longitudinally extending chamber 250 extends from the first or bottom end 230 of the longitudinal housing member 200 to the second or upper end 240 of such housing member 200, and as can be seen, such chamber 250 opens to and communicates at the first end with an opening 260 at the bottom or first end 230 of such longitudinal member 200, which opening communicates with spatial areas outside said opening, thus rendering said interior chamber 250 open at the bottom end 230 and thus open to spatial areas outside the housing member 200. Moreover, the internal chamber 250 extends to the upper end 240 of the housing 200, but is enclosed at the top. Thus, as can be seen, the longitudinal housing member 200 is a hollow finger-like member open only at the bottom end, as shown and described.

As seen in the drawings and particularly FIGS. 4, 5 and 7, there are a plurality of laterally disposed openings 270...270M in the longitudinal housing 200, which openings extend from the inside of chamber 210 to areas outside the housing 200. These latter openings 270A... 270M are laterally disposed to pass air from the inside of chamber 210 to spatial areas outside the housing 200 thereof, as more specifically described below.

As can be seen from the drawings, the upper end of the housing member 200 has a thimble-like cover shield 300 concentrically and conformingly disposed and integrally connected over such second or upper end 240 of such housing member 200. As can be seen from the drawings, such upper thimble-like shield 300 is generally a cylindrical member having a hollow interior spatial area 310 and an open bottom 320 with an opening 325 thereon, and a hemisperical inner upper surface 330 immediately beneath the upper end 335, which is enclosed. As can been seen from the drawings, in the preferred embodiment of the subject invention, with particular references to FIGS. 4 and 5, such cover shield 300 is integrally affixed to the uppermost outer surface 350 on the upper end 240 of the housing member 200 through a solid umbilical extension 380 that is an integral extension between the upper surface 350 of the housing member 200 and the upper inner surface 330 of the shield 300. The umbilical extension 380 is a continuous and integral vertically upwardly extending member of the upper surface of the upper surface 350 of the housing member 200, being a vertical extension thereof that connects directly to the upper inner surface 330 of the cover shield 300, so that the shield 300 is connected integrally to the housing 200 only through such vertically extending umbilical extension 380.

Stated alternately, the upper thimble-like shield 300 is an integral extension of the longitudinally extending housing member 200, and fits conformingly over the upper fingertip-like end 240 of the housing member 200, with the upper male end of such housing member being fitted into the corresponding female receptacle opening 325 formed in the lower part of the cover sheild 300 where the internal chamber 310 is open at the bottom. In this latter structural relationship, the respective longitudinal axis of the cover shield 300 and the upper part of the housing 200 are aligned so that the two members are concentrically joined, as shown in the drawings.

Moreover, as can be seen in the drawings, and particularly figures 4 and 5, the inner diameter of the internal cavity 310 cover shield 300 is slightly larger than the outer diameter of the upper part of the housing such that the cover shield 300 is able to wobble slightly at its bottom portion about the connecting umbilical chord 380, as a pivotal point. More particularly, the lower part 315 of the upper cover shield 300 is structured in its relationship to the upper part of the housing 200 to move laterally in a wobbling manner, in any lateral direction around a 360 degree arc at its bottom part relative to the adjacent outer circumferential surface 450 of the housing member 200, as shown. Thus, when the shield is pushed slightly from any external direction, the opposing portion of the shield moves away from the outer surface of the housing 200, as seen in FIG. 2. This allows a slight spatial area to exist between the housing member 200 and the inner chamber 310 of the cover shield and thus permits air passage from the chamber 310 in the cover shield 300 to the bottom partially exposed opening 375 in the bottom part of the cover shield 300. Note in FIG. 4 that in the preferred embodiment of the subject invention the outer surface 450 of the longitudinal housing member 200, at a point adjacent the bottom extreme of the cover shield 300, has a circumferentially extending ledge 465 having an upper flat surface 475. In the preferred embodiment of the subject invention, the lower extreme circumferentially extending edge 485 forming the bottom opening 375 of the cover shield 300 rests against such ledge 465 in a manner to permit lateral slidable movement in or out away from the outer surface of said longitudinal housing member, as shown, to accommodate the above described wobbling feature.

In viewing the structural relationship between the upper portion of the housing member 200 and the cover shield 300, as seen in figure 4, the internal chamber 310 of such cover shield thus has only a limited area wherein air inside the chamber 310 of such cover shield 300 can escape to the outside and that being the zone described above where the lower circumferential edge 485 of the cover shield extends away from the circumferential ledge in the outer surface of said housing member 200.

As shown diagramatically in FIG. 5, when wind pressure pushes against any one portion of the outer surface 500 of the cover shield 300, it presses such latter portion inwardly towards the outer surface of the housing 200 causing thereby the diametrically opposite portion of the cover shield to move away from the outer surface of the housing 200 with the lower circumferential edge 465 moving out from off the ledge 465, thus exposing interior chamber 310 to the air outside the housing 200. In this manner, relatively moist air inside the roof structure 10, such as in insulation 45, will vent through opening 42 in the roof, up through the opening 215 in the bottom of the housing 200 through internal chamber 210 to lateral openings 270A...270M and thence into chamber 310 in cover shield 300 and then outside through the bottom of the shield 300, by the process described above.

In summary, the subject invention is a device for aiding in the in the removal or alleviation of moisture from under a roof structure, such device comprising a longitudinally extending finger-like housing member, such finger-like member having a first end and a second end, such housing member having a longitudinally extending hollow chamber therein extending from the first end to just short of the second end, such longitudinally extending housing member having a plurality of openings therein extending from the inside of said chamber to areas outside such housing, and a thimble-like cover mounted over the upper part of such housing.

I claim:

1. A device for aiding in the removal or alleviation of moisture from under a roof structure, said device comprising:

(a) a longitudinally extending finger-like housing member with a peripheral outer surface, said finger-like member having a first end and second end, said housing member having a longitudinally extending hollow chamber therein extending from the first end to just short of the second end, said longitudinally extending housing member having a plurality of openings therein extending from the inside of said chamber to areas outside said housing; and wherein said housing member has a circumferential ledge disposed around a portion of the peripheral outer surface of said housing member, said circumferential ledge being disposed between the first end and the second end of such housing member;

(b) a thimble-like cover concentrically mounted over a portion of said housing member, said thimble-like covering being somewhat larger in diameter than the diameter of the housing member, said thimble-like member having a circular bottom opening with a corresponding circular bottom opening edge defining said bottom opening on said thimble-like member, and wherein said circular bottom opening edge is adapted to rest in a nonfixed manner against the circular ledge on the outer periphery of the housing member, whereby said bottom opening edge of said thimble-like member can move away from said ledge with space between said bottom open ledge on said thimble-like covering and said circular ledge on the outer periphery of said housing.

2. A device for aiding in the removal or alleviation of moisture from under a roof structure and adapted for attachment to the upper surface of a roof structure, said device comprising:

(a) a longitudinally extending finger-like housing member, said finger-like member having a first end and second end, said first end being the upper end and said second end being the lower end, said housing member having a longitudinally extending hollow chamber therein extending from the first end to just short of the second end, said longitudinally extending housing member having a plurality of openings therein extending from the inside of said chamber to areas outside said housing, and wherein said hollow chamber has a first opening adjacent the second end of such finger-like member which first opening from said hollow chamber is adapted to communicate and be aligned with a second opening in the roof structure so as to permit air to flow from under the roof through said first and second opening to the hollow chamber in said finger-like member, and wherein said housing member has a circumferential ledge disposed around a portion of the periperal outer surface of said housing member, said circumferential ledge being disposed between the first end and the second end of such housing member;

(b) a thimble-like cover mounted over the upper part of said housing; and a portion of said housing member, said thimble-like covering being somewhat larger in diameter than the diameter of the housing member, said thimble-like member having a circular bottom opening with a corresponding circular bottom opening edge defining said bottom opening on said thimble-like member, and wherein said circular bottom opening edge is adapted to rest in a nonfixed manner against the circular ledge on the outer periphery of the housing member, whereby said bottom opening edge of said thimble-like member can move away from said ledge with space between said bottom open ledge on said thimble-like covering and said circular ledge on the outer periphery of said housing.

3. A device for aiding in the removal or alleviation of moisture from under a roof structure and adapted for attachment to the upper surface of a roof structure, said device comprising:

(a) a longitudinally extending finger-like housing member, said finger-like member having a first end and second end, said first end being the upper end and said second end being the lower end, said housing member having a longitudinally extending hollow chamber therein extending from the first end to just short of the second end, said longitudinally extending housing member having a plurality of openings therein extending from the inside of said chamber to areas outside said housing, and wherein said hollow chamber has a first opening adjacent the second end of such finger-like member which first opening from said hollow chamber is adapted to communicate and be aligned with a second opening in the roof structure so as to permit air to flow from under the roof through said first and second openings to the hollow chamber in said finger-like member and wherein said housing member has a circumferential ledge disposed around a portion of the peripheral outer surface of said housing member, said circumferential ledge being disposed between the first end and the second end of such housing member;

(b) a thimble-like cover mounted over the upper part of said housing, and wherein said housing member has a circumferential ledge disposed around a portion of the peripheral outer surface of said housing member, said circumferential ledge being disposed between the first end and the second end of such housing member, which cover is flared at the bottom portion thereof so as to be movable away from the outer surface of the upper part of said housing, a portion of said housing member, said thimble-like covering being somewhat larger in diameter than the diameter of the housing member, said thimble-like member having a circular bottom opening with a corresponding circular bottom opening edge defining said bottom opening on said thimble-like member, and wherein said circular bottom opening edge is adapted to rest in a nonfixed manner against the circular ledge on the outer peripher of the housing member, whereby said bottom opening edge of said thimble-like member can move away from said ledge with space between said bottom open ledge on the outer periphery of said housing.

* * * * *